US011712737B2

(12) United States Patent
Niane et al.

(10) Patent No.: US 11,712,737 B2
(45) Date of Patent: Aug. 1, 2023

(54) METHOD FOR MANUFACTURING A PLURALITY OF NOZZLE SECTORS USING CASTING

(71) Applicant: SAFRAN, Paris (FR)

(72) Inventors: Ngadia Taha Niane, Moissy-Cramayel (FR); Saïd Boukerma, Moissy-Cramayel (FR); Camille Mettoux, Moissy-Cramayel (FR)

(73) Assignee: SAFRAN, Paris (FR)

( * ) Notice: Subject to any disclaimer, the term of this patent is extended or adjusted under 35 U.S.C. 154(b) by 108 days.

(21) Appl. No.: 17/598,672

(22) PCT Filed: Mar. 20, 2020

(86) PCT No.: PCT/HR2020/050613
§ 371 (c)(1),
(2) Date: Sep. 27, 2021

(87) PCT Pub. No.: WO2020/208325
PCT Pub. Date: Oct. 15, 2020

(65) Prior Publication Data

US 2022/0193761 A1 Jun. 23, 2022

(30) Foreign Application Priority Data

Apr. 8, 2019 (FR) ..... 1903733

(51) Int. Cl.
*B22D 27/04* (2006.01)
*B22C 9/06* (2006.01)

(52) U.S. Cl.
CPC ..... *B22D 27/045* (2013.01); *B22C 9/06* (2013.01)

(58) Field of Classification Search
CPC ..... B22D 27/00; B22D 27/04; B22D 27/045; B22C 9/06
See application file for complete search history.

(56) References Cited

U.S. PATENT DOCUMENTS 5,611,389 A * 3/1997 Alessandri ..... C30B 29/52 164/122.2
8,201,612 B2 * 6/2012 Fargeas ..... C30B 11/002 164/122.2
2015/0027653 A1 1/2015 Guerche et al.

FOREIGN PATENT DOCUMENTS

CN 107745093 A 3/2018
FR 2 724 857 A1 3/1996
(Continued)

OTHER PUBLICATIONS

International Search Report as issued in International Patent Application No. PCT/FR2020/050613, dated Aug. 25, 2020.

*Primary Examiner* — Kevin P Kerns
*Assistant Examiner* — Steven S Ha
(74) *Attorney, Agent, or Firm* — Pillsbury Winthrop Shaw Pittman LLP

(57) ABSTRACT

A process for manufacturing a plurality of single-crystal nozzle sectors each including at least a first blade extending between two platforms by lost-wax casting, includes casting a molten metal into a plurality of ceramic molds distributed in a cluster about an axis, and directional solidification of the cast metal in a furnace comprising a radiant heating element configured to be arranged around the cluster, a solidification front of the metal advancing in each mold in a direction parallel to the cluster axis during directional solidification. Each mold of a second shell separate from a first molding shell of the nozzle sector, which delimits a second cavity for molding a dummy blade acting as a heat shield.

10 Claims, 10 Drawing Sheets

(56) References Cited

FOREIGN PATENT DOCUMENTS

| | | | |
|---|---|---|---|
| FR | 2 874 340 | A1 | 2/2006 |
| FR | 2 995 807 | A1 | 2/2006 |
| FR | 3 031 921 | A1 | 7/2016 |
| FR | 3 070 286 | A1 | 3/2019 |
| GB | 2 259 660 | A | 3/1993 |

* cited by examiner

[Fig. 1]
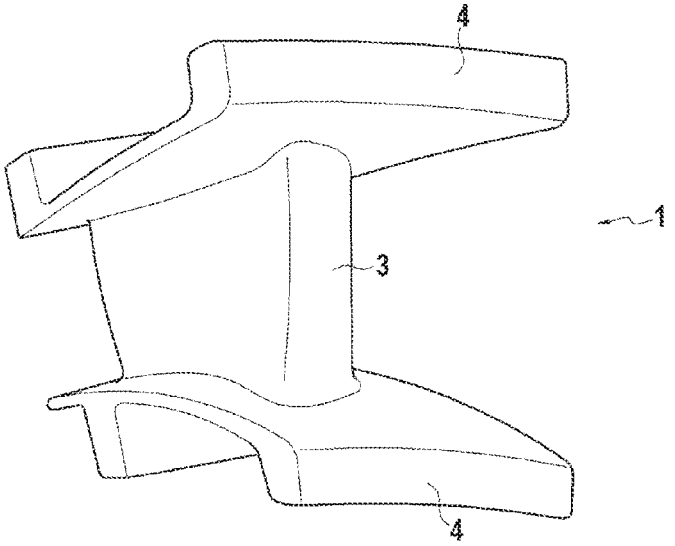
[Fig. 2]
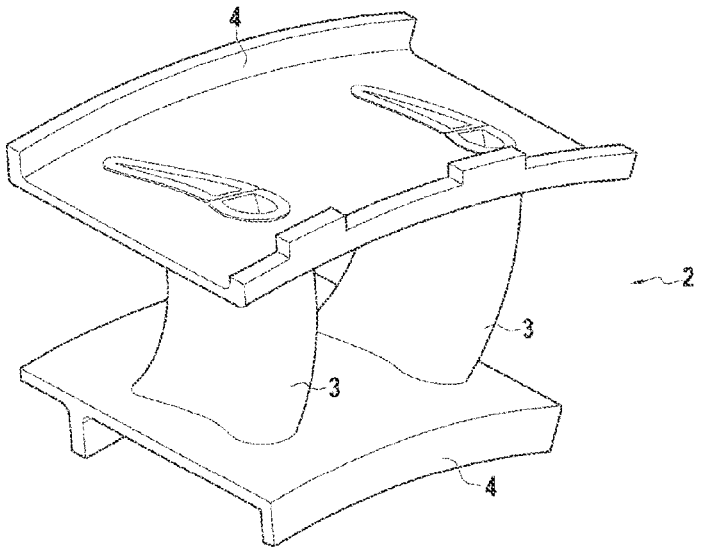

[Fig. 3]
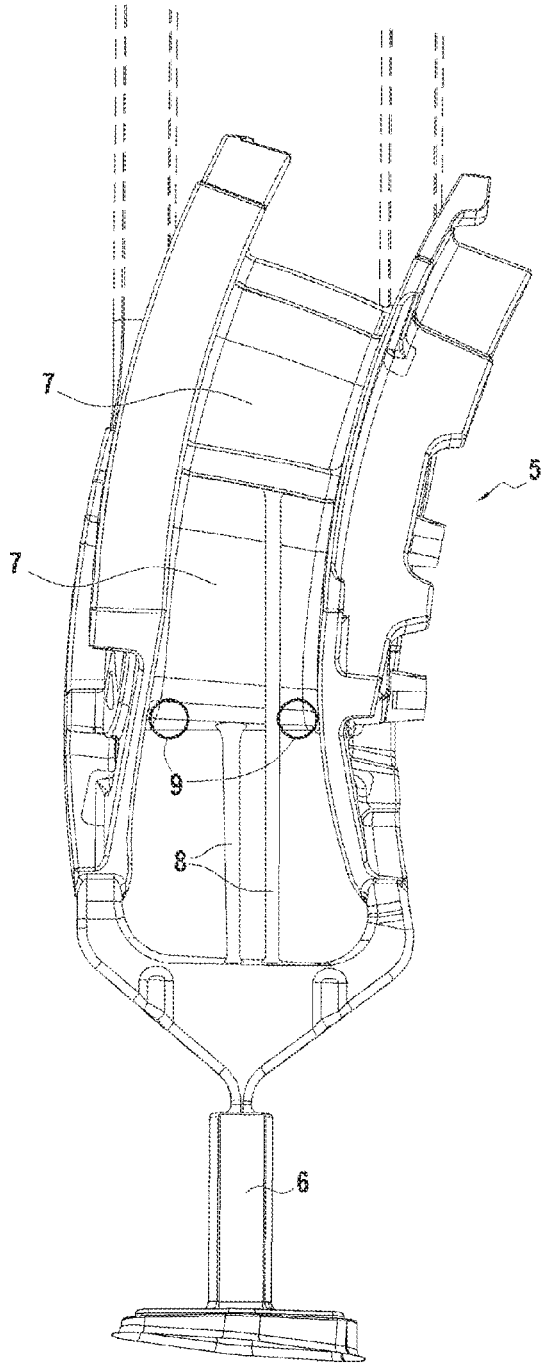
PRIOR ART

[Fig. 4]
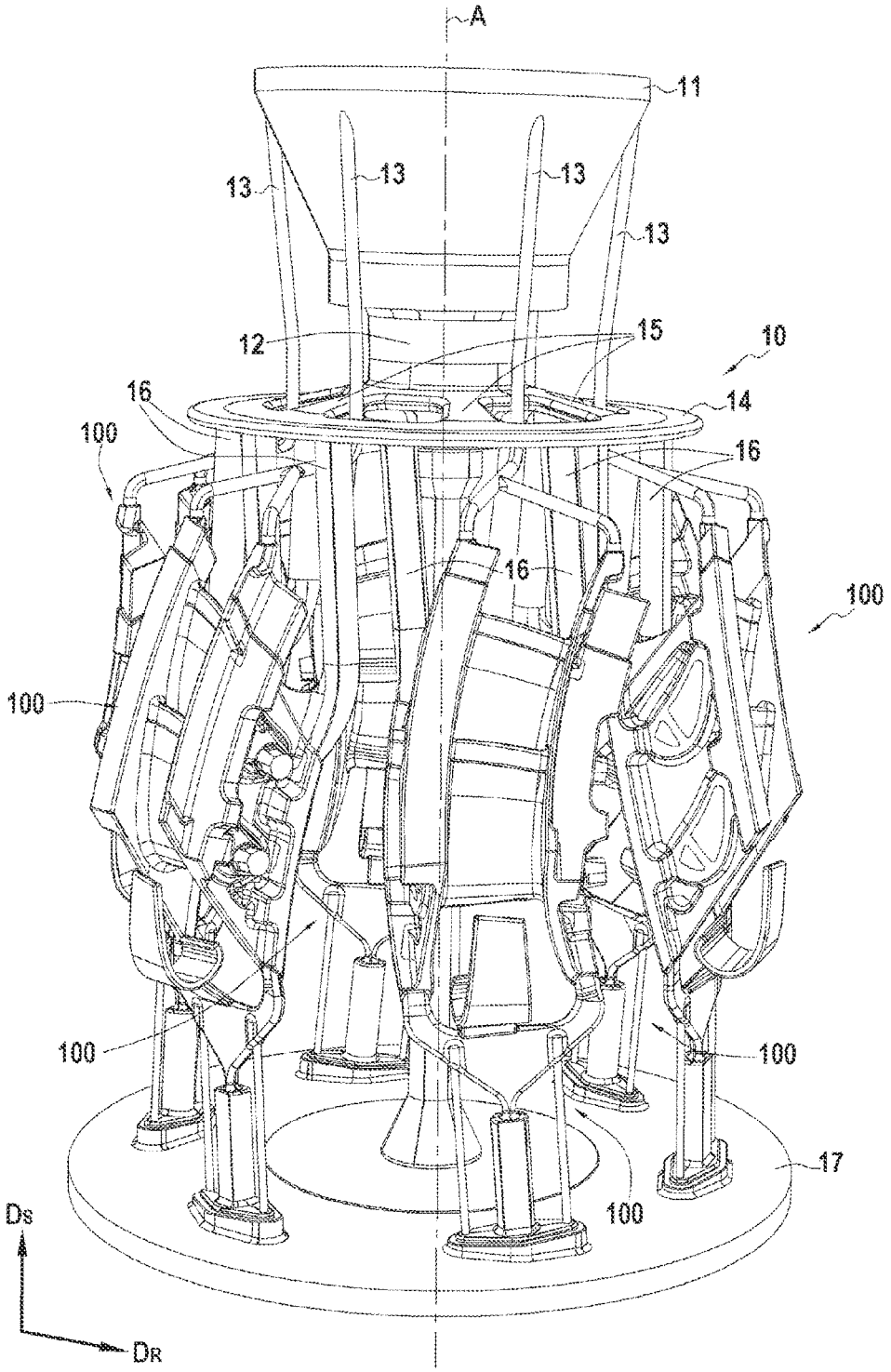

[Fig. 5]
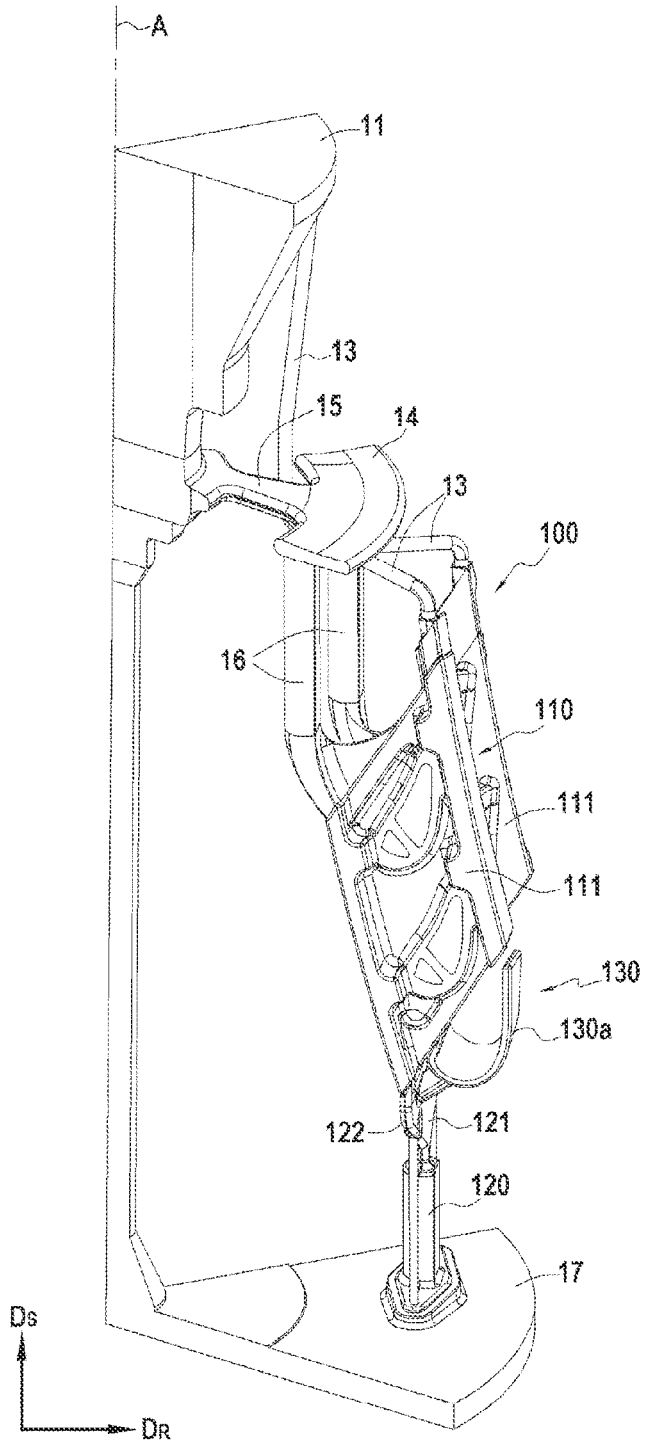

[Fig. 6]
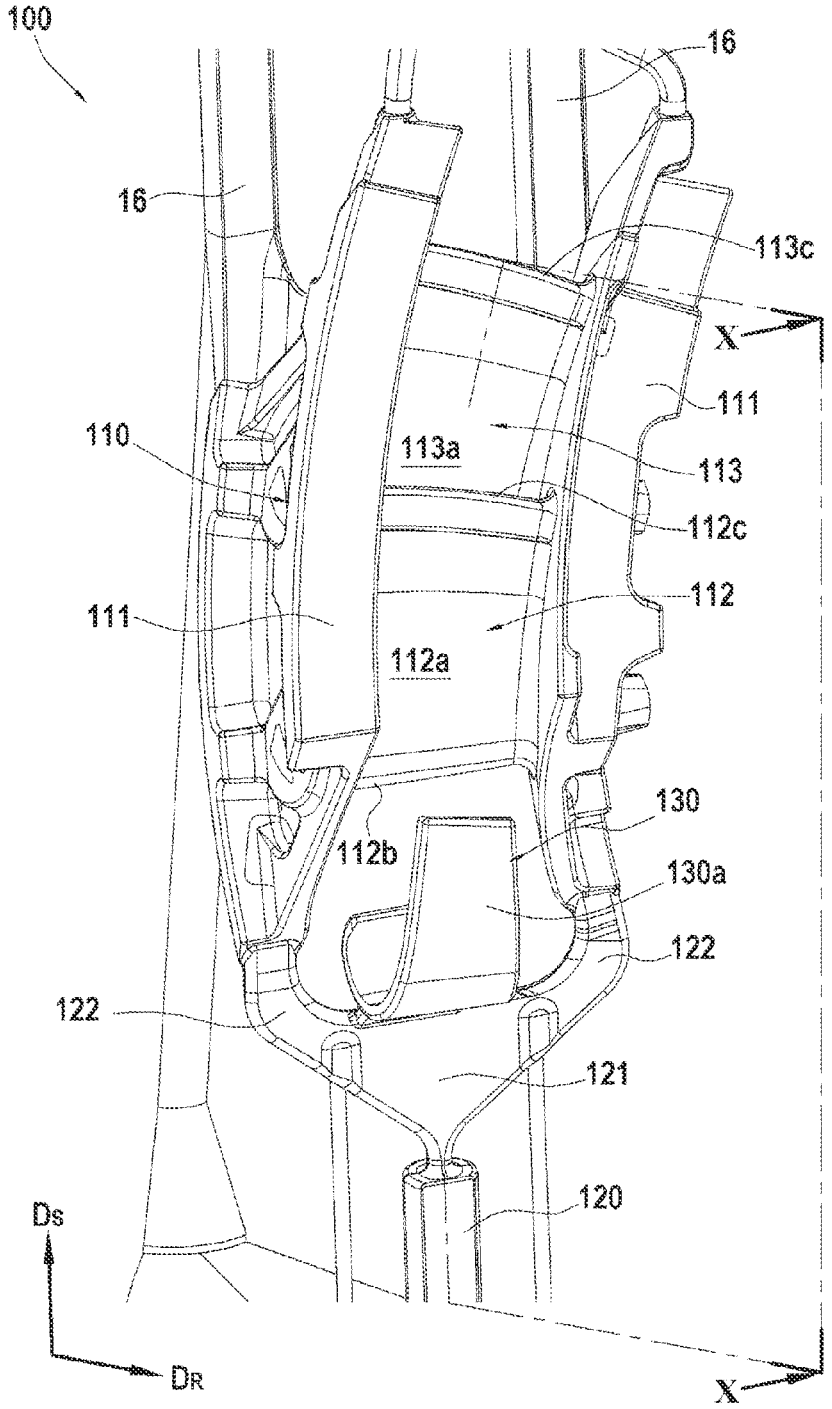

[Fig. 7]
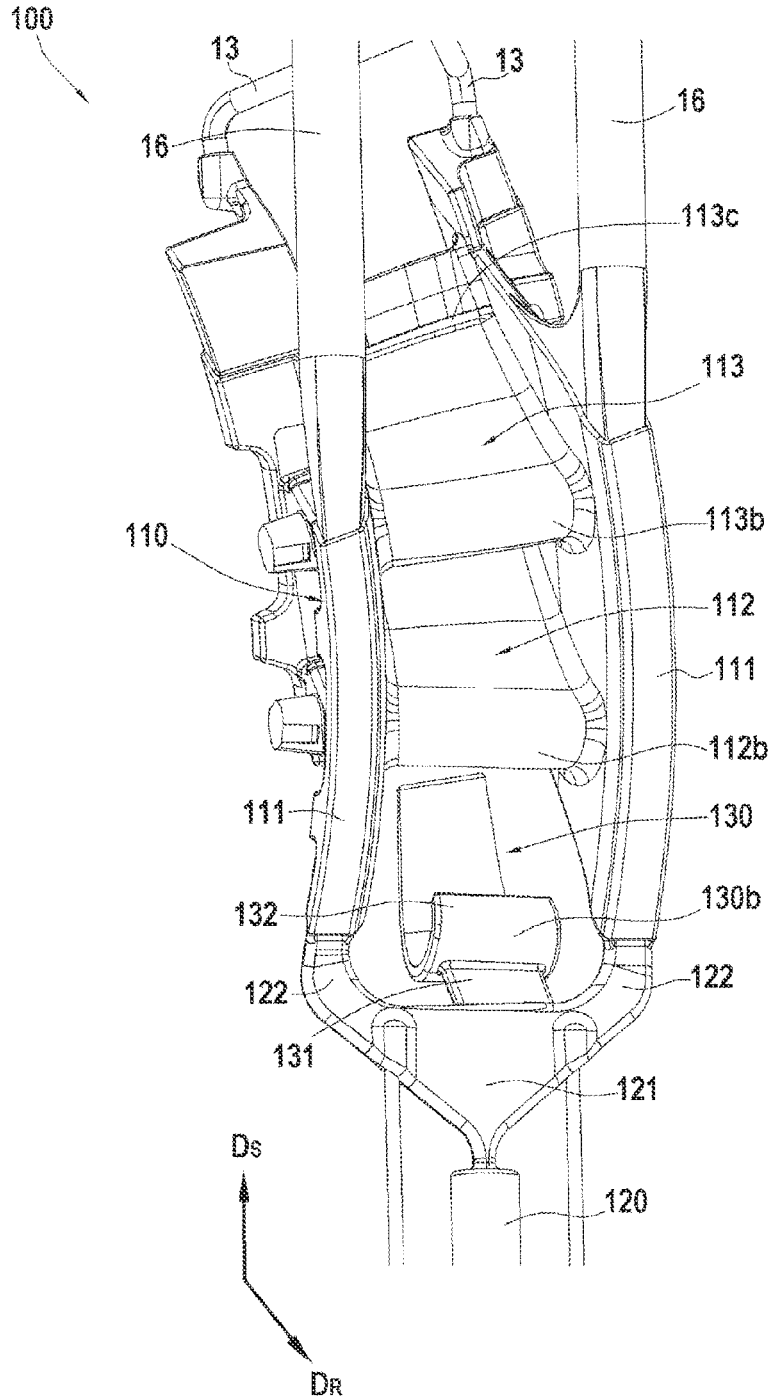

[Fig. 8]
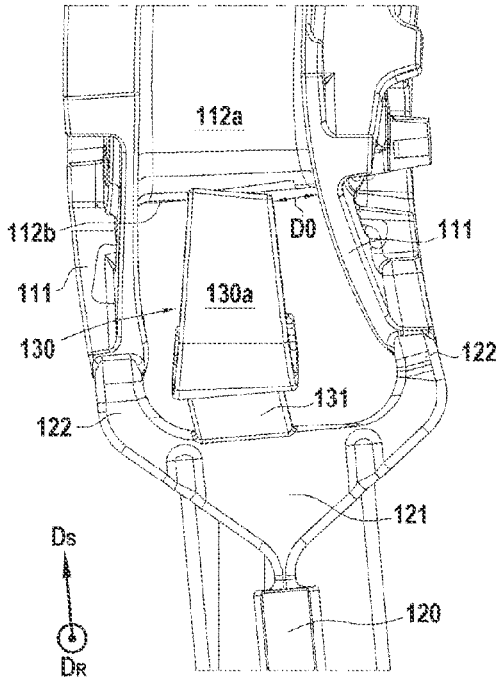
[Fig. 9]
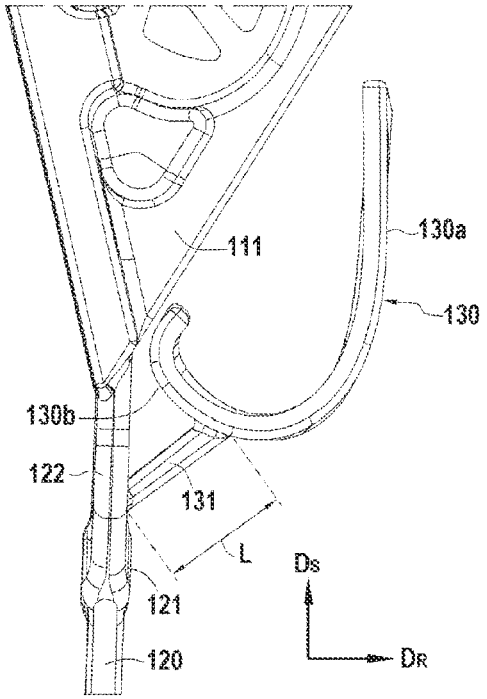

[Fig. 10]
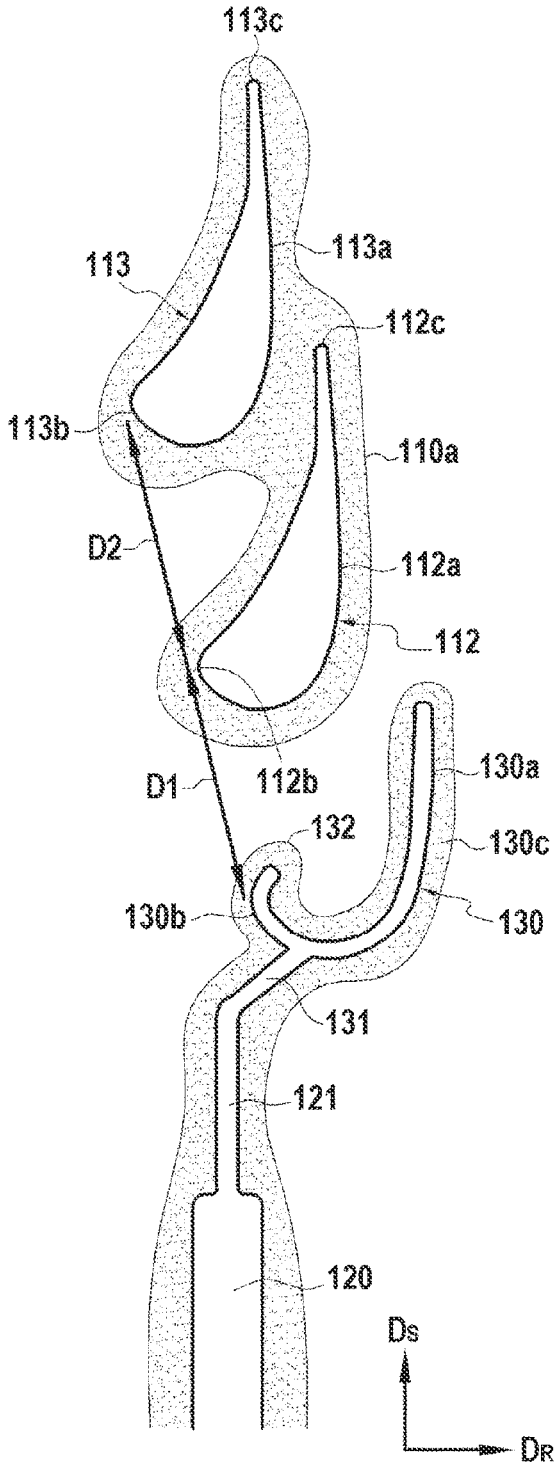

[Fig. 11]
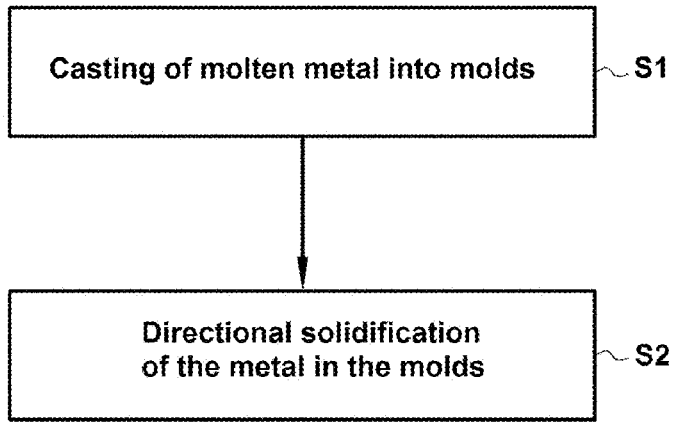

[Fig. 12]
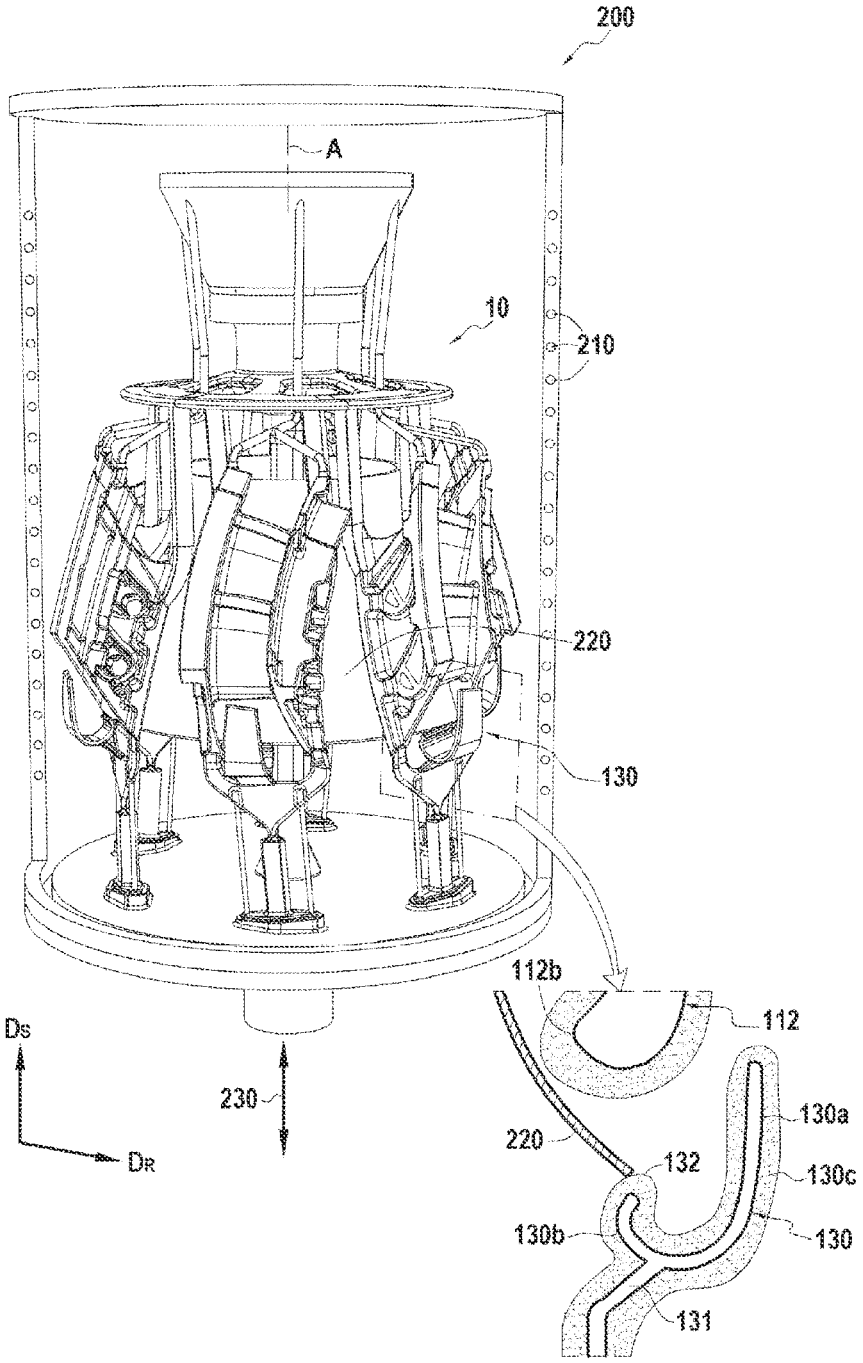

METHOD FOR MANUFACTURING A PLURALITY OF NOZZLE SECTORS USING CASTING

CROSS-REFERENCE TO RELATED APPLICATIONS

This application is the U.S. National Stage of PCT/FR2020/050613, filed Mar. 20, 2020, which in turn claims priority to French patent application number 1903733 filed Apr. 8, 2019. The content of these applications are incorporated herein by reference in their entireties.

TECHNICAL FIELD

The present invention relates to the general field of processes for manufacturing metal turbomachinery components by casting. More particularly, it relates to a process for manufacturing a plurality of single-crystal nozzle sectors each comprising at least one blade extending between two platforms.

PRIOR ART

Metal or metal alloy components with a controlled single-crystal structure are required in certain applications, particularly in aircraft turbomachinery. For example, in aircraft turbomachinery nozzles, the blades must withstand significant thermomechanical stresses due to the high temperature and centrifugal forces to which they are subjected. A controlled single-crystal structure in the metal alloys forming these blades limits the effects of these stresses.

To produce a metal component of this type, lost-wax casting processes are known. In a manner known per se, in such a process, a wax model of the component to be manufactured is first created, around which a ceramic shell is formed as a mold. A molten metal is then cast into the mold, and directional solidification of the metal produces, after removal of the mold, the molded component. This process is advantageous for the manufacture of metal components with complex shapes and produces components with a single-crystal structure by using, for example, a single-crystal grain supplier such as a seed or a grain-selective duct.

The manufacture of aircraft turbomachinery nozzle sectors by such a process is known. FIG. 1 shows, for example, a single-blade nozzle sector 1. FIG. 2 shows, for example, a two-blade nozzle sector 2. A nozzle sector generally comprises one or more blades 3 which extend between two platforms 4 delimiting the flow path of the gas stream. Due to their complex shape, and in order to obtain a single-crystal component, it is often necessary to make ceramic molds comprising devices such as grain supply ducts connecting a single-crystal grain supply device to different parts of the mold cavity, and in particular to the part intended to form the nozzle sector blade(s).

FIG. 3 shows a view of the internal volume of a mold 5 for manufacturing a two-blade nozzle sector 2 such as that of FIG. 2, comprising a grain supply device 6 housing here a single-crystal seed connected to the parts 7 of the mold cavity intended to form the blades 3 by grain supply ducts 8.

Despite these devices, parasitic grains are still present, in particular at the nozzle blade on the identified zones 9 of FIG. 3, and the scrap rate of the components is high. Furthermore, after solidification of the metal, further machining, long and costly, is necessary to remove the grain supply ducts at essential parts such as the leading edge of the blades.

There is thus a need for a process for manufacturing single-crystal nozzle sectors that does not have the above-mentioned disadvantages.

DISCLOSURE OF THE INVENTION

The invention relates to a process for manufacturing a plurality of single-crystal nozzle sectors each comprising at least a first blade extending between two platforms, the process comprising casting a molten metal into a plurality of ceramic molds arranged in a cluster about an axis, and directional solidification of the cast metal in a furnace comprising a radiant heating element configured to be arranged around the cluster, a solidification front of the metal advancing in each mold in a direction parallel to the cluster axis during directional solidification, wherein each mold comprises:

a first shell delimiting a first cavity for molding a nozzle sector, the first cavity having portions forming the platforms of the nozzle sector, and a portion forming a first blade having an outer side with respect to the cluster axis corresponding to a suction side of the first blade, a first edge and a second edge corresponding respectively to a leading edge and a trailing edge of the first blade, the first edge being located upstream of the second edge with respect to the direction of advance of the solidification front, and a single-crystal grain supply device connected by two supply ducts to the portions of the first cavity forming the platforms of the nozzle sector upstream thereof, characterized in that each mold further comprises a second shell separate from the first shell and located upstream thereof with respect to the direction of advance of the solidification front, the second shell delimiting a second cavity for molding a dummy blade connected to the grain supply device, the second cavity having a side corresponding to a suction side of the dummy blade parallel to the outer side of the first cavity.

Throughout the disclosure, the term shell is used to refer to the ceramic envelope of the mold, and cavity is used to refer to an internal volume of the mold into which a metal can be cast.

The process according to the invention differs in particular from the processes of the prior art by the use of molds provided with cavities for molding dummy blades. The presence of these dummy blades forms a thermal radiation shield for each nozzle sector cast, in particular for the blade(s) thereof, during the directional solidification of the cast metal. The separation between the first and second shells prevents thermal bridges between them. The above-mentioned features (second shell for casting a dummy blade, and separation of the first and second shells), in particular, thus drastically reduces the formation of parasitic grains and the number of components scrapped as a result.

In one embodiment, each dummy blade may be independent, i.e. not connected to platforms.

In an example embodiment, the portion of each first cavity forming a first blade may only be in communication with the portions of said cavity forming the platforms.

In an example embodiment, each mold may be devoid of a grain supply duct between the grain supply device and the portion forming the first blade, and between the grain supply device and a second blade, if need be.

In an example embodiment, each dummy blade may be shaped like a curved strip. This shape produces a dummy blade of reduced mass that retains a heat shield function with little impact on the mass and strength of the cluster.

In an example embodiment, each dummy blade may comprise a portion of a pressure side so that each second shell forms a tab extending into the interior of the cluster. The shell formed around this tab may be used to hold, for example, thermal insulation within the cluster.

In an example embodiment, a thermal insulator may be placed inside the cluster during directional solidification, the thermal insulator being held on at least one tab of a second shell. The presence of such a thermal insulator improves temperature homogeneity during directional solidification, provides a more stable solidification front, and thus further reduces the occurrence of parasitic grains. The thermal insulator can be a carbon felt.

In an example embodiment, each mold may further comprise a supply cavity having a triangular shape, the supply ducts and the single-crystal grain supply device being connected to said cavity at the apexes of the supply cavity, the second cavity being connected to the supply cavity at a side thereof located between the two supply ducts.

In an example embodiment, a junction may connect the supply cavity to the second cavity, said junction having a length of at least 12 mm.

In an example embodiment, each nozzle sector may further comprise a second blade, the portion of the first cavity forming the second blade being located downstream of the portion of the first cavity forming the first blade with respect to the direction of advance of the solidification front. This arrangement allows for the manufacture of a two-bladed nozzle sector.

In an example embodiment, each grain supply device may comprise a housing in which a single-crystal seed is present.

In an example embodiment, the cluster may comprise between four and twelve ceramic molds, for example six ceramic molds.

BRIEF DESCRIPTION OF THE DRAWINGS

Other features and advantages of the present invention will emerge from the description below, with reference to the appended drawings which illustrate a non-limiting example embodiment thereof. In the figures:

FIG. 1 shows an example of a single-blade nozzle sector.

FIG. 2 shows a two-blade nozzle sector.

FIG. 3 shows a mold for manufacturing a two-blade nozzle sector used in a process of the prior art.

FIG. 4 shows a cluster comprising several molds for manufacturing two-blade nozzle sectors in a process according to the invention.

FIG. 5 shows a perspective view of a mold of the cluster of FIG. 4.

FIG. 6 shows a detailed front view of the mold of FIG. 5.

FIG. 7 shows a detailed rear view of the mold of FIG. 5.

FIG. 8 shows an enlarged view of FIG. 6 at the second cavity.

FIG. 9 shows an enlarged side view of the mold of FIG. 5.

FIG. 10 shows a cross-sectional view along the plane X identified in FIG. 6.

FIG. 11 shows the main steps of a process for manufacturing a plurality of nozzle sectors according to an embodiment of the invention.

FIG. 12 illustrates the placement of a cluster in a furnace to achieve directional solidification of the cast metal.

DESCRIPTION OF THE EMBODIMENTS

Unless otherwise stated, it should be noted that in the figures, for better readability, the shell corresponding to the ceramic material wall (or envelope) of the cluster and therefore of the molds has not been shown. In other words, only the internal volumes or cavities of a cluster comprising several molds or of a mold are shown. These figures thus show the portions into which a molten metal can be introduced, which also corresponds to the wax model that can be used to make the mold, and to the whole obtained after casting and directional solidification of the metal.

FIG. 4 shows an installation or cluster 10 comprising a plurality of molds 100 for molding two-blade nozzle sectors 2 such as that of FIG. 2 by a process according to the invention, here the molds are six in number. Of course, the cluster 10 may comprise a different number of molds, for example a number between four and twelve. The cluster 10 has a central axis A around which the molds 100 are distributed. The cluster 10 includes a cup 11 through which a liquid metal can be introduced into the cluster 10. The cup 11 overlies a central vertical or downwardly extending duct 12. In the vicinity of the opening of the cup 11 are a plurality of ducts 13 which allow wax to be extracted prior to the step of casting a molten metal for each of the molds 100. A ring 14 connected to the downwardly extending duct 12 by stiffeners 15 distributes the cast molten metal among the molds 100 and feeds them via supply ducts 16. In this example, there are two supply ducts 16 per mold 100. The entire cluster 10 may be placed on a horizontal bottom 17 provided to support the cluster throughout the manufacturing process, which will be described below in connection with FIG. 11. The bottom 17 also helps to avoid complete melting of the single-crystal seed.

A direction Ds is defined corresponding to the direction of propagation of the solidification front of the metal advancing in the cluster during directional solidification. The direction Ds is parallel to the axis A of the cluster 10. In the figures, such a front will advance from the bottom 17 to the cup 11. A direction DR is defined corresponding to a radial direction with respect to the axis A of the cluster 10, which makes it possible to define the terms "inside" and "outside" with respect to the cluster 10.

FIGS. 5 to 9 show different views of a mold 100 corresponding to a sector of the cluster 10.

The mold 100 comprises a first shell that delimits a first cavity 110 for molding the nozzle sector 2. The first cavity 110 comprises portions 111 forming platforms 4 of the nozzle sector 2, a portion 112 forming a first blade 3 (FIGS. 6 and 7) and a portion 113 forming a second blade 3. The portions 112 and 113 are thus each in communication only with the portions 111 forming the platforms. The ducts 13 for discharging wax and the supply ducts 17 are connected to the portions 111 of the first cavity 110. In each mold 100, the portion 112 forming the first blade is located upstream with respect to the direction Ds of the portion 112 forming the second blade.

Each portion 112 and 113 forming a first and a second blade is oriented such that the first and the second blade have a suction side that is located radially (along the direction DR) outwardly from their pressure side. In other words, the portion 112 forming the first blade and the portion 113 forming the second blade each have an outer side 112*a* and 113*a* with respect to the axis A of the cluster 10 that corresponds to the suction side of the first or the second blade.

Furthermore, the portion 112 forming the first blade and the portion 113 forming the second blade each have a first edge 112*b* and 113*b* corresponding to the leading edge of the corresponding blade and a second edge 112*c* and 113*c* corresponding to the trailing edge of the corresponding blade. The nozzle sector is oriented such that the first edges 112*b* and 113*b* are located upstream with respect to the direction Ds of the second edges 112*c* and 113*c*.

The mold 100 further comprises a single-crystal grain supply device 120, which may for example comprise a single-crystal seed in a housing, connected by a triangular supply cavity 121 and two supply ducts 122 to the portions 111 of the first cavity 110 forming the platforms. The device 120 and the supply ducts 121 are connected to the apexes of the triangular supply cavity 121.

In the process according to the invention, each mold 100 further has a second shell, separate from the first shell and located upstream thereof with respect to the direction Ds, delimiting a second cavity 130 for molding a dummy blade. The term "dummy" blade is used because it simulates the presence of a blade of the nozzle sector but is not part of it. Moreover, the dummy blade that will be molded in the second cavity will be separated from the nozzle sector (or removed or disposed of) at the end of the manufacturing process. It is in fact only used during the directional solidification process, where it acts as a thermal radiation shield to reduce the appearance of parasitic grains.

The second cavity 130 is connected by a junction 131 only to the triangular supply cavity 121 at a middle portion of one side thereof. The junction 131 has, in this example, a length L (FIG. 9) of at least 12 mm.

The second cavity 130 has an aerodynamic profile portion, and in particular an outer side 130*a* corresponding to a suction side of a blade, and a first edge 130*b* corresponding to a leading edge of a blade. The dummy blade (and thus the cavity for molding it) has here the shape of a curved strip. In the illustrated example, the dummy blade also comprises a portion of a blade pressure side so that the second shell forms a tab 132 (FIG. 10) extending into the interior of the cluster 10. The second cavity 130 is oriented such that the outer side 112*a* of the portion 112 of the first cavity 110 forming the first blade and the outer side 130*a* are parallel (FIG. 9).

The second cavity 130 may be separated by a minimum distance D0 (FIG. 8) of at least 8 mm from the first cavity 110.

FIG. 10 shows a cross-sectional view along the plane X identified in FIG. 6. Exceptionally in this figure, the ceramic shell of the mold 100 has been shown. In particular, the first shell 110*a*, the second shell 130*c* and the tab 132 of the second shell 130*c* can be seen. It can thus be seen that the first shell 110*a* and the second shell 130*c* are separated so as to avoid a thermal bridge between them. In this figure, it has also been illustrated that the mold 100 may be arranged such that the distance D1 separating the first edge 130*b* of the second cavity from the first edge 112*b*, and the distance D2 separating the first edge 112*b* from the first edge 113*b* may be substantially equal.

For example, when manufacturing single-blade nozzle sectors, the first edges 112*b* and 130*b* of the first cavity and the second cavity may be separated by a distance corresponding to the distance between two leading edges in the particular nozzle.

The cluster 10 and the molds 100 thereof may be made of ceramic material. In a manner known per se, a wax model of the cluster 10 is first obtained. This wax model is then covered with a ceramic shell by successive dips in a suitable slurry and sandblasting (dip-sandblasting). The covered model is finally de-waxed and fired.

FIG. 11 illustrates the main steps of a process for manufacturing a single-crystal nozzle sector 1 or 2 according to the invention using several molds 100 arranged in a cluster 10 such as the one presented above.

The first step S1 of the process consists in filling the molds 100 of the cluster 10 by casting a molten metal into the cluster 10. This can be done by casting the metal directly into the cup 11 of the installation, and it can travel by gravity to fill the molds 100.

The second step S2 of the process comprises the directional solidification of the metal present in the molds. To this end, the cluster 10 filled with molten metal is placed in a furnace 200 (FIG. 12) having a radiant heating element 210 arranged around the cluster 10. A thermal insulator 220 may also be arranged within the cluster, such as a carbon felt, which is held on the tabs 132 of the second shells 130*c* forming the dummy blades. The thermal insulation 220 may be cylindrical or conical in shape and arranged within the cluster around the central channel 12. During this step, the solidification of the component is controlled using a thermal gradient in the furnace 200. The thermal gradient extends generally along the direction Ds. The solidification front moves in the direction Ds from the single-crystal grain supply devices 120 toward the cup 11. The solidification front may be moved by, for example, moving the cluster 10 vertically (also referred to as "pulling") in the furnace 200 (arrow 230). Once the component has solidified, it can be unmolded and finish machined. In particular, the process comprises a step of removing the dummy blade from the solidified assembly to obtain the nozzle sector (in other words, the dummy blade is separated from the nozzle sector thus produced).

It will be noted that the invention has been described in the context of manufacturing a plurality of two-bladed nozzle sectors. The process is of course applicable to the manufacture of a single-bladed nozzle using a cluster provided with several molds each comprising a first molding cavity having only a portion forming a first blade and portions forming the platforms of the sector.

The invention claimed is:

1. A process for manufacturing a plurality of single-crystal nozzle sectors each comprising at least a first blade extending between two platforms, the process comprising casting a molten metal into a plurality of ceramic molds distributed in a cluster about a cluster axis, and directional solidification of the cast metal in a furnace comprising a radiant heating element configured to be arranged around the cluster, a solidification front of the metal advancing in each mold in a direction parallel to the cluster axis during directional solidification, wherein each mold comprises:

a first shell delimiting a first cavity for molding a nozzle sector, the first cavity having portions forming the platforms of the nozzle sector, and a portion forming a first blade having an outer side with respect to the cluster axis corresponding to a suction side of the first blade, a first edge and a second edge corresponding respectively to a leading edge and to a trailing edge of the first blade, the first edge being located upstream of the second edge with respect to the direction of advance of the solidification front, and a single-crystal grain supply device connected by two supply ducts to the portions of the first cavity forming the platforms of the nozzle sector upstream thereof, wherein each mold further comprises a second shell separate from the first shell and located upstream thereof with respect to a direction of advance of the solidification front, the second shell delimiting a second cavity for molding a dummy blade connected to the single-crystal grain supply device, the second cavity having a side corresponding to a suction side of the dummy blade parallel to the outer side of the first cavity.

2. The process as claimed in claim 1, wherein the portion of each first cavity forming a first blade is only in communication with the portions of said cavity forming the platforms.

3. The process as claimed in claim 1, wherein each dummy blade is shaped like a curved strip.

4. The process as claimed in claim 3, wherein each dummy blade comprises a portion of a pressure side so that each second shell forms a tab extending into the interior of the cluster.

5. The process as claimed in claim 4, wherein a thermal insulator is placed inside the cluster during directional solidification, the thermal insulator being held on at least one tab of a second shell.

6. The process as claimed in claim 1, wherein each mold further comprises a supply cavity having a triangular shape, the supply ducts and the single-crystal grain supply device being connected to said cavity at apexes of the supply cavity, the second cavity being connected to the supply cavity at a side thereof located between the two supply ducts.

7. The process as claimed in claim 6, wherein a junction connects the supply cavity to the second cavity, said junction having a length of at least 12 mm.

8. The process as claimed in claim 1, wherein each nozzle sector further comprises a second blade, the portion of the first cavity forming the second blade being located downstream of the portion of the first cavity forming the first blade with respect to the direction of advance of the solidification front.

9. The process as claimed in claim 1, wherein each single-crystal grain supply device comprises a housing in which a single-crystal seed is present.

10. The process as claimed in claim 1, wherein the cluster comprises between four and twelve ceramic molds.

* * * * *